US006860437B1

(12) United States Patent
Amendt et al.

(10) Patent No.: US 6,860,437 B1
(45) Date of Patent: Mar. 1, 2005

(54) JET BARREL FOR A SPA JET

(75) Inventors: Darcy S. Amendt, Edmonton (CA); M. Peter Van't Hoff, Calmar (CA)

(73) Assignee: Blue Falls Manufacturing Ltd., Thorsby (CA)

( * ) Notice: Subject to any disclaimer, the term of this patent is extended or adjusted under 35 U.S.C. 154(b) by 0 days.

(21) Appl. No.: 10/732,406

(22) Filed: Dec. 11, 2003

Related U.S. Application Data

(60) Provisional application No. 60/512,095, filed on Oct. 20, 2003.

(51) Int. Cl.[7] ..... B05B 1/34; B05B 3/16; A61H 33/04; A61H 33/00; A61H 3/00

(52) U.S. Cl. ..... 239/383; 239/381; 239/506; 239/511; 4/541.6; 4/541.3; 4/541.1

(58) Field of Search ..... 4/541.1, 541.2, 4/541.3, 541.4, 541.5, 541.6; 239/383, 382, 381, 380, 463, 505, 506, 511

(56) References Cited

U.S. PATENT DOCUMENTS

| | | | | | |
|---|---|---|---|---|---|
| 4,320,541 | A | | 3/1982 | Neenan | |
| 4,456,174 | A | | 6/1984 | Neenan | |
| 4,502,168 | A | | 3/1985 | Jaworski | |
| 4,508,665 | A | * | 4/1985 | Spinnett | 4/541.6 |
| 4,542,854 | A | | 9/1985 | Mathis | |
| 4,715,071 | A | | 12/1987 | Henkin et al. | |
| 4,800,046 | A | | 1/1989 | Malek et al. | |
| 4,896,383 | A | | 1/1990 | Morgan et al. | |
| 4,965,893 | A | | 10/1990 | Henkin et al. | |
| 5,014,372 | A | | 5/1991 | Thrasher et al. | |
| 5,063,620 | A | | 11/1991 | Mersmann | |
| 5,076,500 | A | | 12/1991 | Daniels | |
| 5,142,714 | A | | 9/1992 | Klotzbach | |
| 5,265,286 | A | | 11/1993 | Filipponi | |
| 5,269,029 | A | | 12/1993 | Spears et al. | |
| 5,291,621 | A | * | 3/1994 | Mathis | 4/541.4 |
| 5,335,376 | A | | 8/1994 | Kaldewei | |
| 5,353,447 | A | | 10/1994 | Gravatt | |
| 5,386,598 | A | | 2/1995 | Mersmann | |
| 5,639,029 | A | | 6/1997 | Sundholm | |
| 5,657,496 | A | | 8/1997 | Corb et al. | |
| 5,810,257 | A | | 9/1998 | Ton | |
| 5,920,925 | A | | 7/1999 | Dongo | |
| 5,956,784 | A | * | 9/1999 | Perdreau et al. | 4/541.1 |
| 6,112,341 | A | | 9/2000 | Moreland | |
| 6,178,570 | B1 | | 1/2001 | Denst et al. | |
| 6,334,224 | B1 | | 1/2002 | Chalberg et al. | |
| 6,470,509 | B1 | | 10/2002 | Ayeni | |
| 6,497,375 | B1 | | 12/2002 | Srinath et al. | |
| 2003/0226199 | A1 | * | 12/2003 | Holtsnider | 4/541.6 |

* cited by examiner

*Primary Examiner*—Michael Mar
*Assistant Examiner*—Seth Barney
(74) *Attorney, Agent, or Firm*—Sean W. Goodwin; Linda M. Thompson

(57) ABSTRACT

A jet barrel adapted for use in a spa jet housing having a rotor rotatably supported on a spindle pin aligned along a longitudinal axis in the bore of the jet barrel. The spindle pin is supported at upstream and downstream pivot points. An offset nozzle extends from a conical base of the rotor, an inlet to the rotor being aligned with an outlet from the jet barrel's bore. As water exits the jet barrel bore into the rotor, the rotor and spindle pin are caused to co-rotate. Hard water deposits, sufficient to prevent rotation do not readily build around the pivot points.

10 Claims, 5 Drawing Sheets

PRIOR ART

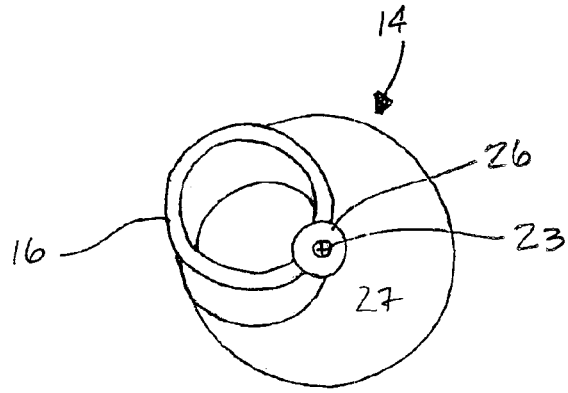
Fig. 4b
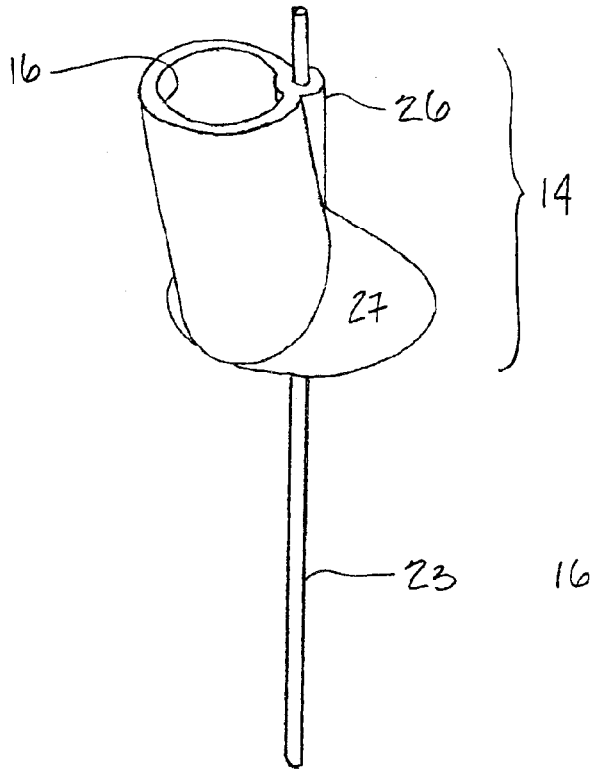
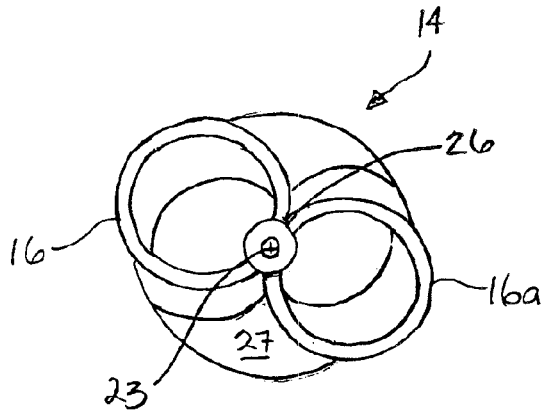
Fig. 4c
Fig. 4a

JET BARREL FOR A SPA JET

CROSS REFERENCE TO RELATED APPLICATIONS

This application is a related to and claims the benefit of now abandoned U.S. Provisional application Ser. No. U.S. 60/512,095, filed Oct. 20, 2003, the entirety of each of which is incorporated herein by reference.

FIELD OF THE INVENTION

The invention relates to spa jets for a hot tub or hydrotherapy tub and more particularly relates to spa jets having a jet barrel and a nozzle rotatably fixed within the jet barrel for minimizing clogging in the jet barrel which would prevent rotation.

BACKGROUND OF THE INVENTION

It is known to use rotary jets in a spa to direct a stream of water through one or more nozzles which rotate, to provide a swirling or agitating motion to the water which acts against the users skin and muscle tissue.

Typically, as taught in U.S. Pat. No. 6,123,274 to Perdreau et al., spa jets of this type have a housing which is connected at an inlet to a pressurized water source. A nozzle is supported in a jet barrel in the housing by a radial ball bearing in an open cup-shaped portion of the jet barrel. The nozzle typically has an angular passage, radially offset from the central axis of the housing and jet barrel so that as the water enters the inlet and is caused to exit the passage, the nozzle is rotated on the bearing.

Commonly, debris and hard water deposits become lodged about the ball bearing and between the nozzle and the jet barrel. Over time, the nozzle stops spinning as a result of the buildup. In order to restore proper jet action, the jets must be removed from the spa, dismantled, cleaned and re-assembled. The repair is costly and time consuming and often results in wholesale replacement of the jet.

Others have attempted to design spa jets that minimize clogging of the jet due to debris. U.S. Pat. No. 6,491,238 to Swanson et al. describes a spa jet having a flow guide or baffle which reduces the amount of water and acts to slow down flow of water internally within the jet and reaching the radial ball bearing. This slowing of the water is believed to diminish the amount of debris that reaches the bearing while still maintaining a small flow of water to the bearing to act as a lubricant. A debris pocket defined between the flow tube and the baffle wall acts to collect settled out particulates. While this type of baffle reduces the amount of debris such as plastics, sand, hair, dirt and greases such as from suntan oil, body oils and the like, it does not act to prevent the buildup of scale such as hard water deposits, in at least a portion of the areas having small tolerances, such as between the nozzle and the housing and in the baffles and the bearing races, as a result of the remaining flow of water in these areas.

Clearly, what is required is a nozzle that can maintain rotation within the housing regardless that the environment may be inclined to deposit hard water deposits around the rotating aspects of the jet.

SUMMARY OF THE INVENTION

A jet barrel, adapted to fit within a conventional spa jet housing, comprises a rotor, having an offset tubular outlet extending from a curvilinear, preferably conical base, the rotor being supported in a bore of the jet barrel by means, preferably a spindle pin constrained against reactive loads at a downstream point. The rotor and the spindle pin co-rotate about the downstream pivot point and an upstream guide due to the action of a stream of pressurized water which enters the jet barrel at an upstream inlet and exits through the rotor's offset nozzle. The downstream pivot point is a small surface area point load between a hard bearing surface and the spindle. A clearance fit socket is provided to guide the spindle pin and maintain the downstream point on the bearing surface. Preferably both the pin point and bearing surface are stainless steel.

The conical base of the rotor defines an inlet to the rotor and the tubular nozzle forms an outlet. The rotor's inlet is supported adjacent a downstream outlet of the jet barrel's bore, sufficiently above the outlet to ensure rotation of the rotor without permitting the flow of water to bypass the rotor inlet.

In a broad aspect of the invention, the jet barrel comprises a jet barrel housing defining a barrel bore having a downstream outlet and an upstream inlet, the barrel bore defining a longitudinal axis, the jet barrel adapted for fitting within the spa jet housing, the upstream inlet being adjacent at least one of the one or more spa jet housing inlets; and a rotor, rotatably supported at an upstream end and at a downstream end in the barrel bore aligned with the longitudinal axis, the rotor having an inlet supported at or above the downstream outlet and a tubular nozzle outlet angled offset from the longitudinal axis of the jet barrel.

Preferably, the means to support the rotor is a spindle pin which is supported for co-rotation with the rotor at an upstream and downstream end of the jet barrel. The downstream pivot point, preferably a stainless steel inset, is fit within a hub supported at the center of a jet barrel face by a plurality of angled vanes. The insert provides a surface against which the spindle pin is contacted axially and upon which it can rotate. Further, the arrangement is insensitive to buildup of hard water deposits land the like. The upstream pivot point comprises an upset having a small bore which aids in positioning the spindle pin radially along at the longitudinal axis and permits the spindle pin to rotate loosely therein. As the bore is not a bearing surface, it is sized sufficiently with a clearance to permit rotation of the pin therein without interference from hard water deposits and the like.

Preferably, the jet barrel housing has an upstream inlet which is adapted to be positioned adjacent an inlet in the spa jet housing through which a stream of pressurized water flows into the jet barrel's bore.

More preferably, the jet barrel has a second inlet, positioned downstream from the first inlet and adapted to be positioned against a second inlet in the spa jet housing through which a stream of pressurized air can be admitted to the water stream for enhancing the flow of water through the jet barrel.

BRIEF DESCRIPTION OF THE DRAWINGS

FIG. 4*a* is a perspective view of the nozzle and spindle pin according to FIG. 2;

FIG. 4*b* is a plan view of the rotor illustrating an offset nozzle outlet;

FIG. 4*c* is a plan view of a rotor comprising one or more additional offset nozzle outlets

DETAILED DESCRIPTION OF THE PREFERRED EMBODIMENT

Figure 1:
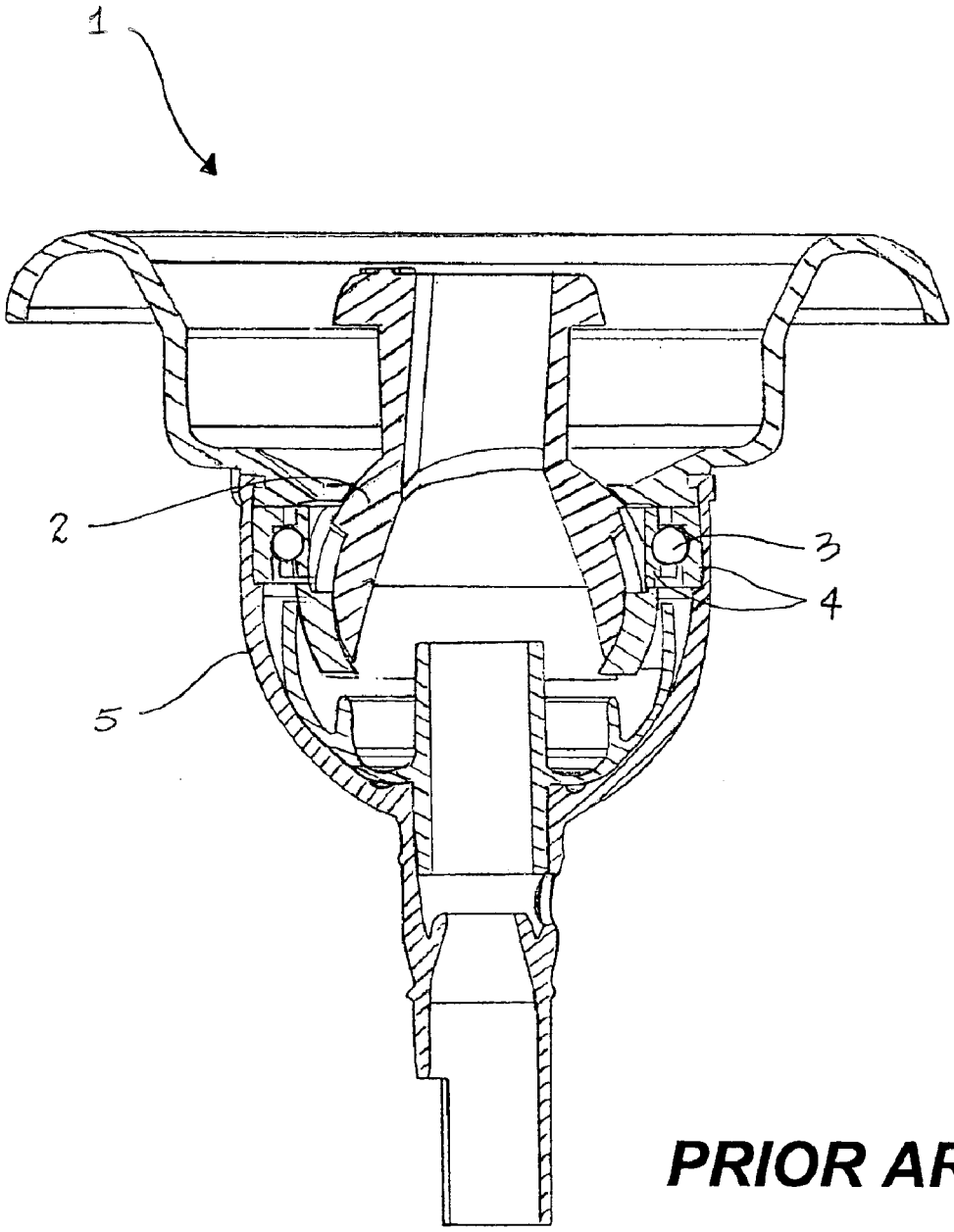
FIG. 1 is a cross-sectional view of a prior art rotary spa jet.

According to FIG. 1, a prior art spa jet 1 is shown. A semicircular nozzle 2 is supported by ball bearings 3 in bearing races 4 for rotation within a housing 5. Water, flowing through the bearing races 4 and around the nozzle 2, causes hard water deposits and debris to build-up, resulting in eventual plugging and cessation of rotation.

Figure 2:
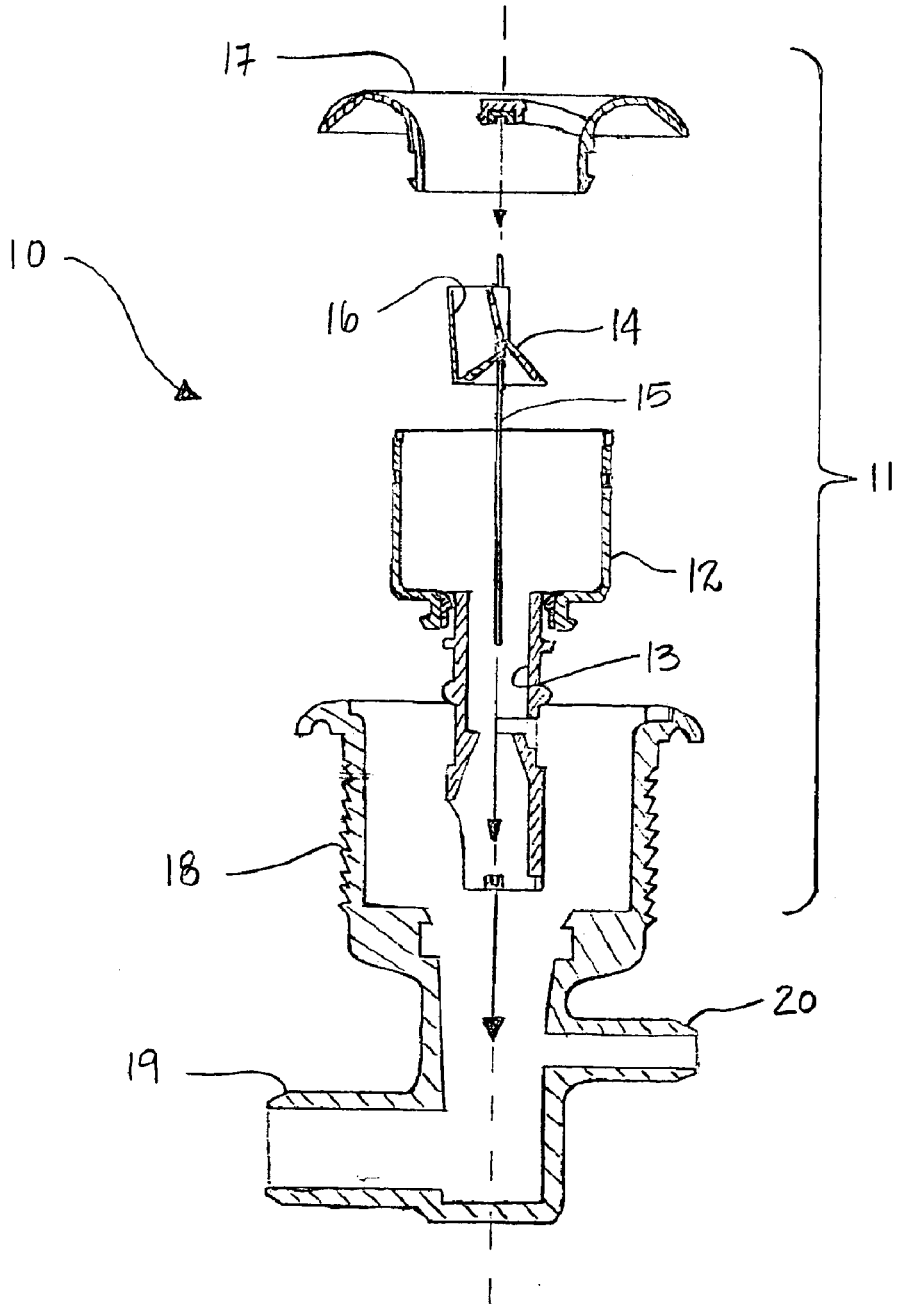
FIG. 2 is an exploded cross-sectional view of a spinning spa jet of the present invention, illustrating the relationship between a spa jet housing, a jet barrel, a; rotor and nozzle supported for co-rotation with a spindle pin and a housing face having angled vanes.

Having reference to FIG. 2, a spa jet 10 comprising one embodiment of a spa jet barrel 11 of the present invention is shown. The spa jet barrel 11 further comprises a jet barrel housing 12 defining a bore 13 and having a longitudinal axis, a rotor 14, means 15 for rotatably supporting the rotor 14 in the bore 13, a tubular nozzle 16 fluidly connected to the rotor 14 and extending at an angle offset from the longitudinal axis and a jet barrel face 17. The jet barrel 11 is adapted for fitting within a spa jet housing 18, having a first inlet 19 connected to a pressurized water source, and optionally, a second inlet 20 positioned downstream from the first inlet 19, for connection to a source of pressurized air for enhancing the flow of water through the jet barrel 11.

Figure 3:
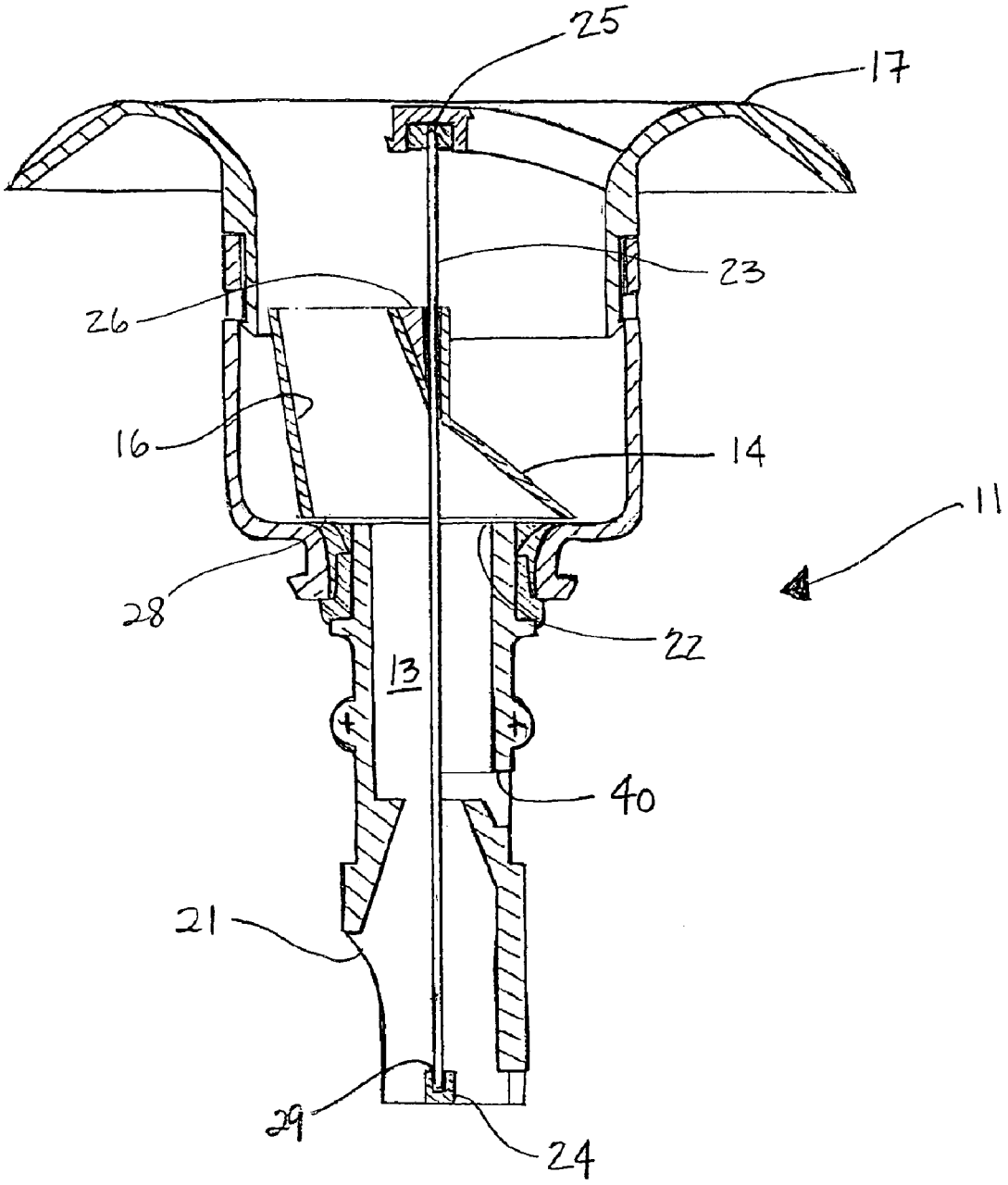
FIG. 3 is a cross-sectional view of the jet barrel according to FIG. 2.

As shown in greater detail in FIG. 3, the jet barrel 11 further comprises an upstream inlet 21, which is adapted to be positioned adjacent the first inlet 19 of the spa jet housing 18. The rotor 14 is supported adjacent an outlet 22 at a downstream end of the jet barrel bore 13 which discharges water from the bore 13 into the tubular nozzle 16.

In a preferred embodiment of the invention, as shown in FIGS. 3, 4*a* and 4*b*, the rotor 14 is rotatably supported in the bore 13 using a spindle pin 23. The spindle pin 23 is supported for rotation along the longitudinal axis of the jet barrel 11 at a first pivot point 24 at the upstream end of the jet barrel 11 and supported axially and for rotation at a second pivot point 25 on the jet barrel face 17. Further, the rotor 14 is frictionally fit to the spindle pin 23 through a projection 26 aligned with the longitudinal axis and extending from the offset nozzle 16 so as to cause the rotor 14 to co-rotate with the spindle pin 23.

The spindle pin 23 at the second pivot 25 is a conical point so as to provide a point load in the axial direction. The spindle pin at the first pivot point 24 need only be supported radially as the second pivot point absorbs the axial loading. Water does act to radially guide the pin 23 in the first and second pivot points.

The rotor 14 further comprises a curvilinear base 27. Preferably the base 27 is conical, however other shapes such as a portion of a spherical shape scribing an equi-radial surface are also permissible. The base 27 forms a rotor inlet 28, the rotor inlet 28 being positioned adjacent the jet barrel's downstream outlet 22, sufficiently above the jet barrel's outlet 22 to permit rotation of the rotor 14 thereabove while not permitting the flow of water to be diverted from the rotor's inlet 28. Pressurized water enters the upstream inlet 21 of the jet barrel housing 11 and is forced through the bore 13 to the downstream outlet 22, into the rotor inlet 28 and exits through the tubular offset nozzle 16 causing the rotor and spindle pin 23 to co-rotate about the pivot points 24,25.

Alternatively, as shown in FIG. 4*c*, one or more additional offset nozzle outlets 16*a* . . . may be fluidly connected to the rotor 14.

Figure 5A:
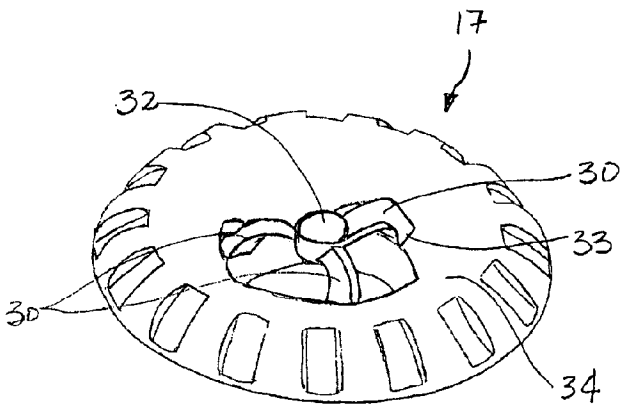
FIG. 5*a* is a perspective view of the housing face according to FIG. 2.
Figure 5B:
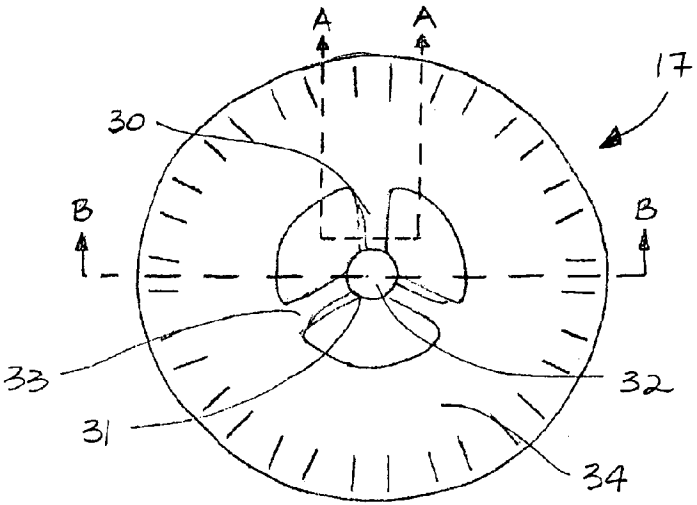
FIG. 5*b* is a plan view of the housing face according to FIG. 5*a;*
Figure 5C:
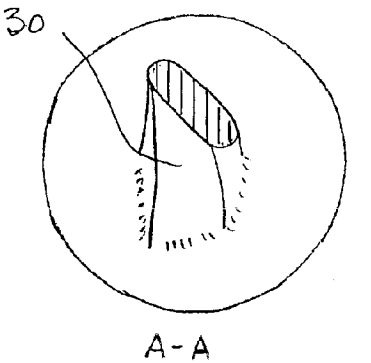
FIG. 5*c* is a cross-sectional view of one of the angled vanes according to FIG. 5*a*.

Preferably, as shown in FIGS. 5*a*–5*d*, the jet barrel face 17 is fit with a plurality of angled vanes 30 which act to redirect the water as it exits the rotating tubular nozzle 16 to enhance the action of the water against the users skin and muscles. The vanes 30 are connected at a first end 31 to central hub 32 and at a second end 33 to the outer rim 34 of the jet barrel face 17. The vanes 30 are angled as shown in FIG. 5*c*.

Figure 5D:
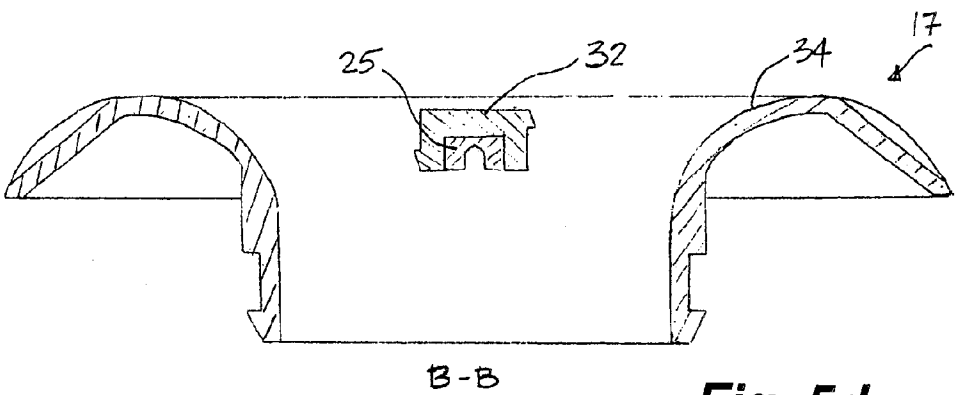
FIG. 5*d* is a cross-sectional view of the housing face according to FIG. 5*a*.

As shown in FIG. 5*d*, the second pivot point 25, typically a stainless steel inset, is fit within the hub 32. The second pivot point 25 provides a surface upon which the spindle pin 23 is forced due to the pressure of the water and upon which the spindle pin 23 can rotate. Further, the inset 25 does not readily permit the buildup of hard water deposits and the like therein.

As shown in FIG. 3, the upstream pivot point 24 is typically an upset or guide having a bore 29 in which the spindle pin 23 is supported for rotation. The upset bore 29 is sized to permit rotation of the spindle pin 23 therein, but does not permit buildup of hard water deposit and the like.

Most preferably, as shown in FIG. 3, the jet barrel housing 11 is fit with a second inlet 40 which is adapted to be positioned adjacent the second inlet 20 of the spa jet housing for permitting pressurized air to be introduced into the stream of water in the jet barrel housing's bore 13 for enhancing the flow of water through the bore 13.

The embodiments of the invention in which an exclusive property or priviledge is claimed are defined as follows:

1. A Jet barrel for a spa jet housing having a bore defining a longitudinal axis and having at least one inlet formed therein for passage of pressurized fluid to the bore, the jet barrel comprising:

a jet barrel housing defining a barrel bore having a downstream outlet and an upstream inlet, the barrel bore defining a longitudinal axis, the jet barrel adapted for fitting within the spa jet housing, the bore's upstream inlet being adjacent at least one of the one or more spa jet housing inlets; and a rotor, and a spindle pin rotatably supported in the barrel bore and aligned with the longitudinal axis, the rotor being caused to co-rotate with the spindle pin by the flow of water therethrough, and having an inlet supported at or above the bore's downstream outlet and a tubular nozzle outlet angled offset from the longitudinal axis of the jet barrel, the spindle pin having an upstream end and a downstream end, the upstream end being radially guided at an upstream end of the bore and the downstream end having a conical point; and a bearing surface formed at a downstream end of the bore for axially supporting the conical point thereon, wherein the rotor and the spindle pin are rotationally supported on the conical point and radially guided at the upstream and downstream ends.

2. The jet barrel as described in claim 1 further comprising a housing face having a plurality of angled vanes for directing flow of water therefrom.

3. The jet barrel as described in claim 1 wherein the rotor comprises a conical base for supporting the tubular nozzle angled offset from the longitudinal axis, the conical base defining the rotor inlet.

4. The jet barrel as described in claim 1 further comprising a second inlet, positioned downstream from the bore's upstream inlet, adapted to be positioned adjacent a second inlet in the housing, wherein pressurized water is introduced into the bore through the upstream inlet and air is introduced into the bore through the second inlet.

5. The jet barrel as described in claim 1 further comprising:

a guide at the upstream pivot point for radially guiding the upstream end of the spindle pin therein, the guide being sized sufficient to prevent buildup of deposits therein.

6. The jet barrel as described in claim 1 further comprising one or more additional tubular nozzle outlets angled offset from the longitudinal axis of the jet barrel.

7. A spa jet comprising a spa jet housing and a jet barrel as set forth in claim 1.

8. The jet barrel as described in claim 1 wherein the bearing surface is an inset sized sufficient to prevent buildup of deposits therein.

9. The jet barrel as described in claim 8 wherein the inset is fit within a hub at a center of a housing face.

10. The jet barrel as described in claim 8 wherein the conical point and the inset are stainless steel.

* * * * *